United States Patent [19]

Karinthi et al.

[11] Patent Number: 4,676,694

[45] Date of Patent: Jun. 30, 1987

[54] PROCESS AND INSTALLATION FOR THE CONGELATION OF GROUNDS BY MEANS OF A CRYOGENIC LIQUID

[75] Inventors: Pierre Karinthi, Jouy-en-Josas; Maurice Gardent, Herbeys; Colette Régniér, Echirolles; Jean Tuccella, Grenoble, all of France

[73] Assignee: l'Air Liquide, Societe Anonyme pour l'Etude et l'Exploitation des Procedes Georges Claude, Paris, France

[21] Appl. No.: 739,602

[22] Filed: May 29, 1985

[30] Foreign Application Priority Data

Jun. 1, 1984 [FR] France ..... 84 08647

[51] Int. Cl.[4] ..... E02D 3/115

[52] U.S. Cl. ..... 405/130; 405/258

[58] Field of Search ..... 405/54, 56, 130, 258, 405/270; 165/45

[56] References Cited

U.S. PATENT DOCUMENTS

| | | | |
|---|---|---|---|
| 3,220,470 | 11/1965 | Balch . | |
| 3,267,680 | 8/1966 | Schlumberger | 405/130 |
| 4,403,459 | 9/1983 | Hurlbut | 405/130 X |

FOREIGN PATENT DOCUMENTS

| | | |
|---|---|---|
| 3112291 | 10/1982 | Fed. Rep. of Germany . |
| 2041356 | 1/1971 | France . |
| 2113980 | 6/1972 | France . |
| 642058 | 8/1950 | United Kingdom . |

*Primary Examiner*—David H. Corbin

*Attorney, Agent, or Firm*—Young & Thompson

[57] ABSTRACT

The injection of liquid nitrogen into the probe (2) is regulated in an on-off manner so as to maintain the temperature of the ground at the coldest point above a value within the range of between −140° C. and −160° C. so as to cause calefaction of the liquid nitrogen. The liquid nitrogen is alternately injected into the central passage (9) and into the annular passage (11) of the probe, these passages being thermally insulated from each other.

7 Claims, 2 Drawing Figures

Figure 1:
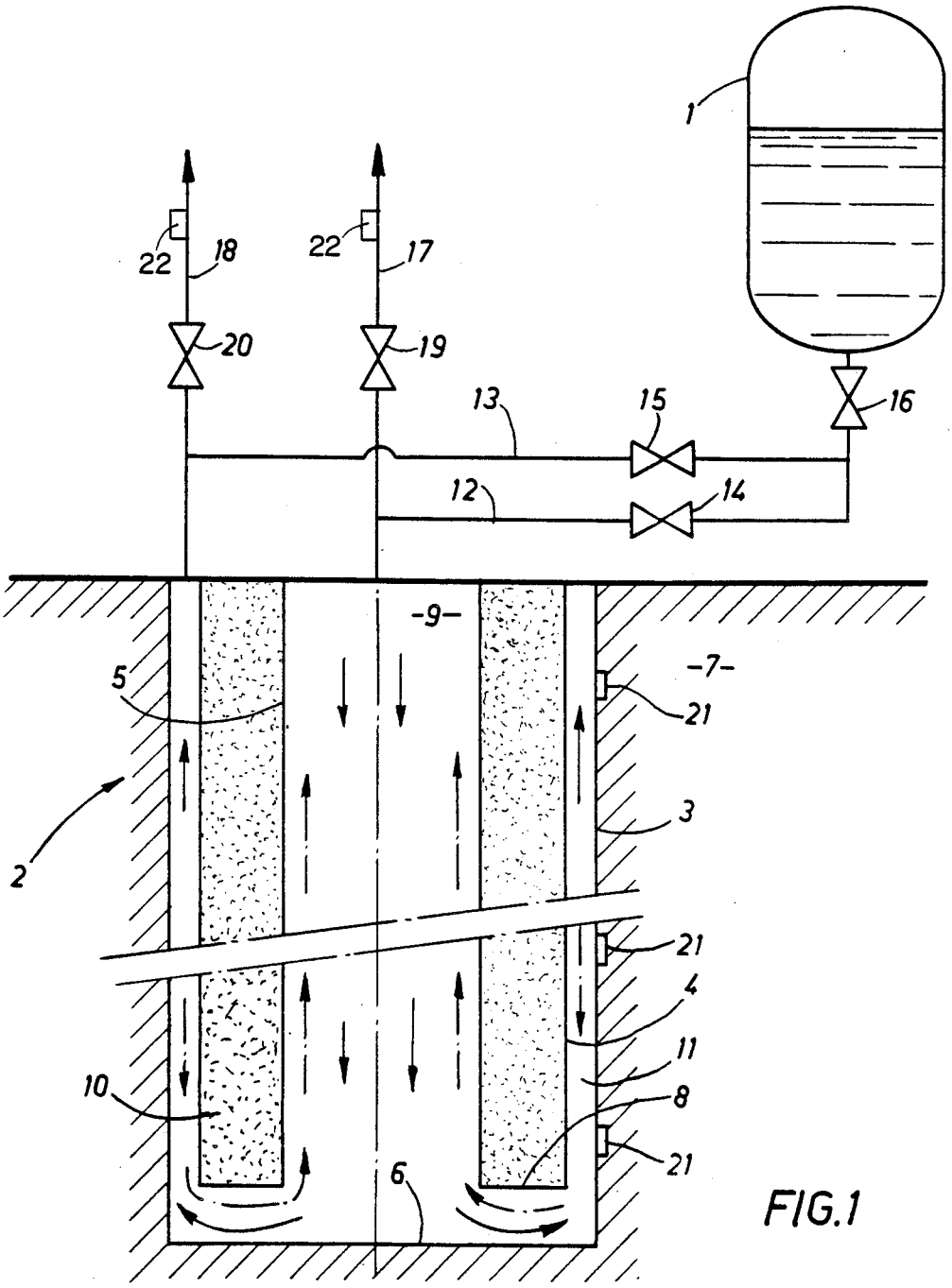

PROCESS AND INSTALLATION FOR THE CONGELATION OF GROUNDS BY MEANS OF A CRYOGENIC LIQUID

The present invention relates to the technique of the congelation of grounds by the injection of a cryogenic liquid, in particular liquid nitrogen, in at least one congelation probe driven into the ground.

It is known that the consolidation of grounds by congelation permits the opening of public works sites in damp and unstable grounds. It is carried out by the injection of a refrigerating liquid in probes introduced in different regions in the ground. This cooling congeals the ground progressively until a continuous wall is formed when the congelation regions of each probe have reached those of neighbouring probes.

It is known to inject a cryogenic liquid such as liquid nitrogen into the probes. This direct injection of liquid nitrogen has several drawbacks and in particular the difficulty of controlling the thermal exchange coefficients with the ground. Indeed, in liberating cold, the nitrogen is vaporized and the coefficients of exchange between the probe and first of all the pure liquid nitrogen and then the mixtures of liquid and gas in variable proportions, and then the cooled gas alone are very different. There results a high heterogeneity of the thickness of the congealed ground around the probe and a loss of time and energy to ensure that the least congealed regions join up to form the consolidated wall, while the most congealed regions are unnecessarily subcooled and over-dimensioned. Further, as the grounds are usually heterogeneous, certain parts become congealed more rapidly than other parts; this heterogeneity of the ground still further increases the extent of the unnecessarily congealed and subcooled regions.

An object of the invention is to render the process more economical by achieving a more homogeneous cooling of the ground.

The invention therefore provides a process for the congelation of the ground by the injection of a cryogenic liquid, in particular liquid nitrogen, in at least one congelation probe driven into the ground, wherein the injection of the cryogenic liquid is so regulated as to maintain the temperature of the ground in the neighbourhood of the probe, throughout the length of the latter, above a predetermined limit value, this limit value being higher by about at least 35° C. than the cryogenic liquid boiling temperature.

In this way it is guaranteed that the temperature difference between the wall of the probe and the cryogenic liquid is sufficient to produce permanently the calefaction of the cryogenic liquid in contact with this wall. Consequently, the heat exchange between the liquid and the wall of the probe always occurs through a gaseous calefaction layer. In this way an excessive transfer of cold to the wall which would be produced by the direct contact between the liquid and the wall if the temperature of the wall of the probe descended too close to the boiling point of the liquid is avoided. These conditions, which are usually encountered in the processes of the prior art, permit a very rapid transfer of cold but this can only be achieved in a very limited height of the probe.

In particular, when the cryogenic liquid is liquid nitrogen, said limit value is preferably between about −140° C. and −160° C.

In an advantageous manner of carrying out the process which ensures a good utilization of the available cold, the rate of flow of the cryogenic liquid is so regulated during the injection periods as to obtain a temperature of the gas as it leaves the probe in the neighborhood of a predetermined value which is preferably equal to about −70° C. in the case of liquid nitrogen.

The homogeneity of the cooling is still further improved when, with the probe having a central passage and an annular passage, the periods of injection of the cryogenic liquid into the central passage and the periods of injection of the cryogenic liquid into the annular passage are alternated.

The invention also has for an object to provide a congelation installation for carrying out a process such as that defined hereinbefore. This installation is of the type comprising at least one congelation probe and means for injecting into said probe a cryogenic liquid such as liquid nitrogen, and is characterized in that the probe comprises at least one temperature sensor on its outer wall in the vicinity of one of its ends.

Figure 2:
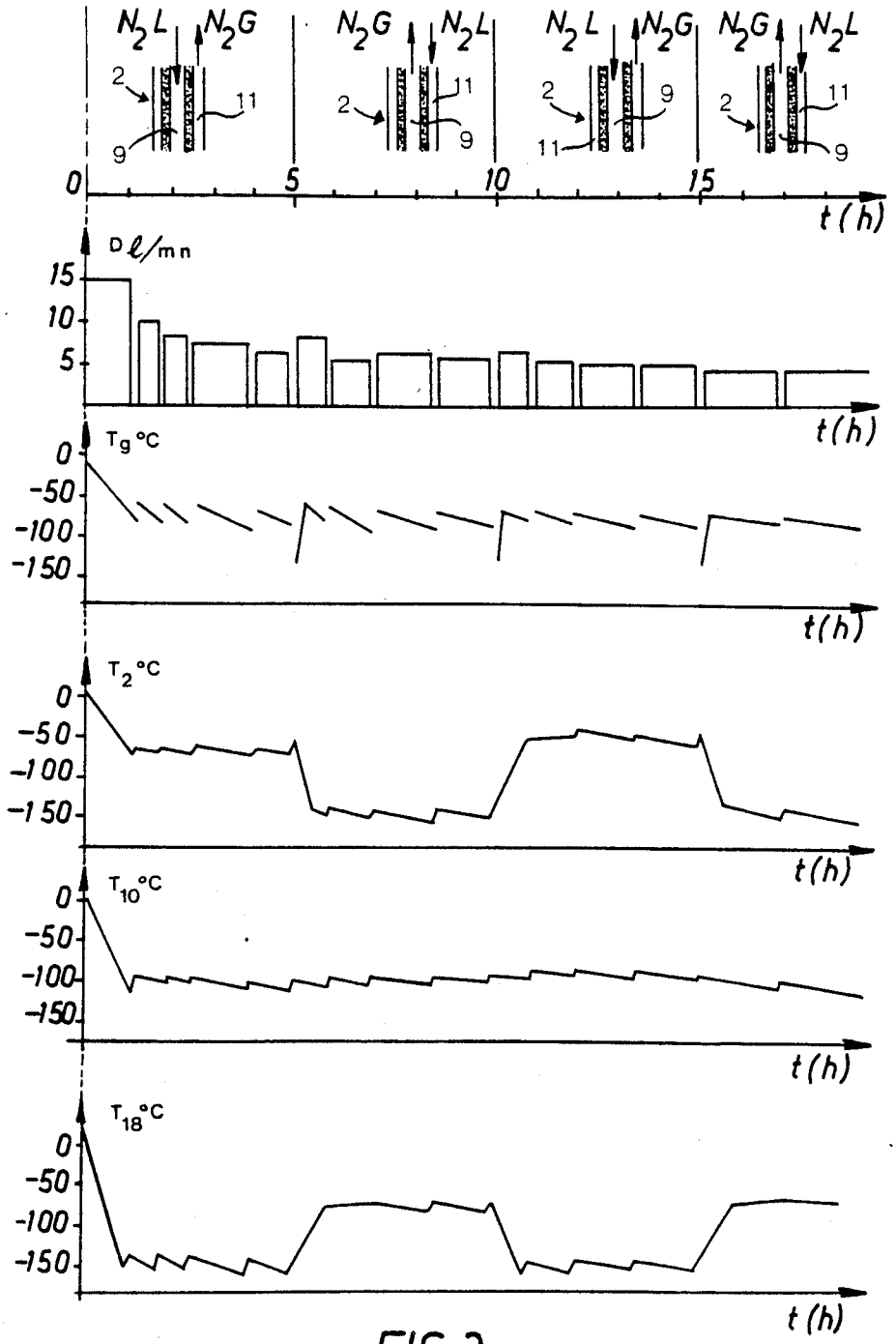

An embodiment of the invention will now be described with reference to the accompanying drawings in which:

FIG. 1 is a diagram of a part of a congelation installation according to the invention, and FIG. 2 is a diagram illustrating the operation of this installation.

The congelation installation shown in FIG. 1 comprises mainly a tank 1 for storing liquid nitrogen and a series of congelation probes 2, only one of which has been represented, these probes being identical to one another.

The probe 2, which is assumed to be driven vertically into the ground, comprises three concentric tubes 3 to 5. The outer tube 3 is closed at its lower end by a bottom 6 and defines with the latter the thermal exchange area of the probe with the surrounding ground 7. The intermediate tube 4 and the inner tube 5 extend from the upper orifice of the probe down to a short distance from the bottom 6 and they are interconnected in this region by a horizontal annular wall 8.

There are thus defined in the probe 2: a central passage 9 defined by the inner tube 5 and opening onto the bottom 6; an intermediate annular space 10 defined by the tubes 4 and 5 and the wall 8 which may be filled with a thermally insulating material such as perlite; and an outer annular passage 11 defined between the tubes 3 and 4 and opening onto the bottom 6.

The installation further comprises means for injecting liquid nitrogen into the passages 9 and 11. These injection means comprise two pipes 12 and 13 respectively communicating with these two passages and connected to the lower part of the tank 1 and provided with respective control valves 14 and 15. A common control valve 16 which also regulates the rate of flow is also provided at the outlet of the tank.

The upper end of the passages 9 and 11 is also provided with gas discharging means, diagrammatically represented by the respective pipes 17, 18 provided with their respective stop valves 19, 20.

The valves 14, 15, 18 and 19 are provided with a device (not shown) simultaneously actuating the valves and having two positions. In a first position, the valves 14 and 20 are open while the valves 15 and 19 are closed; the other position inverses the state of the four valves. The valve 16 enables the flow of liquid nitrogen to be stopped and resumed.

On the outer side of the outer tube 3, the probe 2 carries three temperature sensors 21, for example formed by thermocouples which are adapted to measure the temperature of the ground in the immediate vicinity of the probe at depths of 2 m, 10 m and 18 m respectively (temperatures $T_2$, $T_{10}$ and $T_{18}$ respectively). Also provided is a temperature sensor 22 connected to each of the pipes 17 and 18 and adapted to measure the temperature $T_G$ of the gaseous nitrogen issuing from the probe.

The installation in fact comprises a series of probes 2 disposed along a line which defines the congealed wall to be produced. All the probes are connected in parallel to the tank 1 in the manner described hereinbefore, each probe having its own set of valves 14, 15, 16, 18 and 19.

The operation of this installation, illustrated in FIG. 2, is based on a double regulation of the injection of liquid nitrogen into the probes, each probe being regulated independently of the others so as to take into account the heterogeneity of the ground:

On the one hand, the supply of liquid nitrogen is regulated in an on-off manner by means of the valve 16 so that the temperature of the ground at the coldest point always remains between two predetermined limit values, with the aid of indications given by the temperature sensors 21 of the considered probe. As explained before, the lower limit is at least equal to −160° C. so as to ensure the permanent presence of a gaseous calefaction layer between the liquid nitrogen and the tube 3 so that the whole of the thermal exchange between the nitrogen and the probe is a gas-metal exchange.

On the other hand, during the periods of injection of the liquid nitrogen, as soon as the transitional stage of cooling has finished, the rate of flow of the liquid is regulated by means of the valve 16 in such manner that the gas resulting from the vaporization of the liquid nitrogen has, as it issues from the probe, a temperature in the neighbourhood of a predetermined set temperature so chosen as to optimize the utilization of the cold. A set temperature on the order of −70° C. has been found satisfactory.

This manner of proceeding distinctly improves the homogeneity of the cooling of the ground relative to the case where, according to the technique of the prior art, the rate of flow of the liquid nitrogen was merely regulated as a function of the temperature of the gas issuing from the probe. However, it is not possible to avoid merely by the foregoing regulations a large temperature gradient between the bottom and the top of the probes. In order to avoid this heterogeneity for the most part, the valves 14, 15, 19 and 20 of all the probes are periodically reversed.

Thus, in assuming that one started by injecting for several hours liquid nitrogen through the central passage 9 and discharging gaseous nitrogen through the peripheral passage 11, the inversion has for result to inject liquid nitrogen into the passage 11 and to discharge gaseous nitrogen through the central passage 9.

There is reached in this way, after several hours, a new inverted equilibrium in which the coldest point, regulated between the aforementioned two temperature limits, is located at the top of the probe and the least cold point at the bottom. It will be understood that a good thermal homogeneity is achieved in the ground by periodically inverting the flows of nitrogen.

The following numerical example will illustrate the process just described.

It is desired to consolidate as rapidly as possible by congelation a wall having a thickness of 1 m in a damp sandy ground to a depth of 20 m and a width of 50 m. For this purpose, fifty probes 2 spaced 1 m apart from another are driven into the ground.

Each probe has an outside diameter of 150 mm and consists of three concentric tubes 3 to 5 having diameters 150 mm, 120 mm and 68 mm respectively. The central annular space between the tube 4 of 128 mm and the tube 5 of 68 mm is filled with perlite. The diameters are so chosen that the free section of the central passage 9 and the free section of the outer annular passage 11 are equal.

The congelation commences by the injection of liquid nitrogen into the central tubes 5. The temperatures in the neighbourhood of the probes are all initially on the order of 14° C. In each probe, the nitrogen is vaporized and liberates cold to the ground and rises up the outer annular passage. The rate of flow D of liquid nitrogen per probe is the maximum rate of flow of 15 l/min. (namely 750 l/min. for the fifty probes) regulated by means of the valves 16.

There will now be described by way of a numerical example, with reference to FIG. 2, the behaviour of a single probe, it being understood that each of the probes is regulated independently of the others. The limit values of the coldest temperature of the ground are chosen to be −145° C. and −138° C., and the set outlet value of the gaseous nitrogen is −70° C.

The temperature of the gaseous nitrogen issuing from the probe drops during the first hour from −10° C. to −70° C. During this time, the external temperatures reach −140° C. at 18 m, −100° C. at 10 m and −62° C. at 2 m depth. As the transitional phenomena of the cooling of the ground are still noticeable, the injection of liquid nitrogen is continued at the same rate of flow for a further 10 min. during which the outlet temperature of the gaseous nitrogen reaches −78° C. and the external temperature at 18 m reaches −145° C.

The injection of liquid nitrogen is then stopped. After 10 min. the external temperature at 18 m rises to −138° C. A rate of flow of 10 l/min. of liquid nitrogen is reestablished. This flow is lower than before since the cold temperature of −145° C. had been reached only for an excessively low temperature of the gaseous nitrogen issuing from the probe.

After 20 minutes, the external temperature at 18 m again drops to −145° C. and the outlet temperature of the gases drops to −75° C. The supply of nitrogen is again stopped and then resumed at 8 l/min. (for the same reason as before) when the temperature at 18 m rises to −138° C.

This alternating procedure concerning the injections and the stoppages is continued while reducing the rate of flow so long as the temperature of the gases drops below −70° C. The rate of flow is maintained constant when this temperature is stabilized within a range of −68° C. to −72° C. and it is increased if this temperature rises above −68° C., and reduced if it redescends below −72° C.

After 5 hours of congelation, the flows of all the probes are reversed by the injection of liquid nitrogen through the outer annular passage 11 with the gas issuing through the central passage 9.

The rate of flow is then fixed at 8 l/min. The gas initially issues in a very cold state at −120° C.; it is a transitional condition resulting from the passage of the nitrogen in a counter-current manner relative to the temperature gradient of the ground. After 10 min., the outlet temperature of the gas rises to −70° C. and the external temperatures are established at: −100° C. at 2 m, −100° C. at 10 m, −65° C. at 18 m; 20 min. later, the external temperature is at −145° C. and the gas issues from the probe at −75° C.

The supply of nitrogen is stopped and is resumed at 7 l/min. when the temperature at 2 m rises to −138° C., which occurs at the end of about 5 min.

This succession of injections and stoppages is continued for 5 hours, by modifying, as the case may be, the flow of liquid nitrogen in the manner indicated hereinbefore. The flows are again inverted at the end of this period.

The regulation thus defined is continued by inverting the flows every 5 hours. The ground is consolidated by congelation at a thickness of 1 m in about 50 hours with a very satisfactory temperature homogeneity.

What is claimed is:

1. A process of congelation of the ground by injection of a cryogenic liquid, in particular liquid nitrogen, in at least one congelation probe driven into the ground and having an outer wall, said process comprising regulating the injection of the cryogenic liquid in such manner as to maintain the temperature of the ground in the neighborhood of the probe, throughout the length of the probe, above a predetermined limit value, said limit value being higher by at least about 35° C. than the boiling temperature of the cryogenic liquid, and to effect heat exchange between the liquid and the probe wall always through a gaseous calefaction layer.

2. A process according to claim 1, wherein the cryogenic liquid is liquid nitrogen and said limit value is between about −140° C. and about −160° C.

3. A process according to claim 1, comprising interrupting the injection of cryogenic liquid when said limit value is reached and resuming said injection when the temperature of the ground at the coldest point has risen to a second limit value.

4. A process according to claim 1, comprising regulating the rate of flow of cryogenic liquid during the injection periods in such manner as to obtain a temperature of the gas as it issues from the probe in the neighbourhood of a second predetermined value.

5. A process according to claim 4, wherein the cryogenic liquid is liquid nitrogen and said predetermined value is equal to about −70° C.

6. A process according to claim 1, comprising employing a probe comprising a central passage and an annular passage that communicate with each other at the lower end of the probe, and alternating periods of injection of the cryogenic liquid into the central passage and periods of injection of the cryogenic liquid into the annular passage.

7. A process of congelation of the ground by injection of a cryogenic liquid, in particular liquid nitrogen, in at least one congelation probe driven into the ground, said process comprising employing a probe comprising a central passage and an annular passage that communicate with each other at the lower end of the probe, and alternating periods of injection of the cryogenic liquid into the central passage and periods of injection of the cryogenic liquid into the annular passage.

* * * * *